US008390651B2

(12) United States Patent
Huang et al.

(10) Patent No.: US 8,390,651 B2
(45) Date of Patent: Mar. 5, 2013

(54) DRIVING METHOD AND DRIVING APPARATUS FOR DISPLAYING APPARATUS

(75) Inventors: Kuei-Wei Huang, Taipei (TW); Yi-Cheng Tsai, Taoyuan County (TW); Qi-Ming Lu, Changhua County (TW); Jhen-Shen Liao, Taoyuan County (TW); Kuan-Hung Liu, Taipei County (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 909 days.

(21) Appl. No.: 12/430,881

(22) Filed: Apr. 27, 2009

(65) Prior Publication Data

US 2010/0033507 A1 Feb. 11, 2010

(30) Foreign Application Priority Data

Aug. 8, 2008 (TW) ..... 97130344 A

(51) Int. Cl.
*G09G 5/10* (2006.01)

(52) U.S. Cl. ..... 345/690; 345/89

(58) Field of Classification Search ..... 345/87–100, 345/204, 690

See application file for complete search history.

(56) References Cited

U.S. PATENT DOCUMENTS

| | | | | |
|---|---|---|---|---|
| 6,107,978 | A * | 8/2000 | Nagaoka et al. | 345/60 |
| 7,432,881 | B2 * | 10/2008 | Kawahaea et al. | 345/63 |
| 2005/0231492 | A1 * | 10/2005 | Shen et al. | 345/204 |
| 2007/0097064 | A1 * | 5/2007 | Okita et al. | 345/101 |
| 2007/0216623 | A1 * | 9/2007 | Kimura | 345/89 |
| 2008/0055226 | A1 * | 3/2008 | Huang et al. | 345/100 |
| 2008/0198115 | A1 | 8/2008 | Lin | |
| 2008/0198118 | A1 * | 8/2008 | Choi | 345/89 |
| 2008/0284773 | A1 * | 11/2008 | Baek et al. | 345/211 |

FOREIGN PATENT DOCUMENTS

| | | |
|---|---|---|
| CN | 101241690 A | 8/2008 |
| JP | P2007248639 A | 9/2007 |
| TW | 200811828 | 3/2008 |

* cited by examiner

*Primary Examiner* — Amare Mengistu
*Assistant Examiner* — Stacy Khoo
(74) *Attorney, Agent, or Firm* — Winston Hsu; Scott Margo

(57) ABSTRACT

A driving method for driving a display apparatus is provided. The driving method includes: configuring a plurality of driving voltages corresponding to a plurality of gray scales, where the gray scales include a first gray scale and a second gray scale smaller than the first gray scale, and a first driving voltage corresponding to the first gray scale is lower than a second driving voltage corresponding to the second gray scale; and controlling the display apparatus to display a gray scale merely up to the second gray scale. In this way, the driving method hence reduces the response time of the display apparatus, which may be an LCD display panel.

14 Claims, 5 Drawing Sheets

| Gray scales of a fore scene / Gray scales of a current scene | 0(0) | 1(32) | 2(64) | 3(96) | 4(128) | 5(160) | 6(192) | 7(208) | 8(224) | 9(240) | 10(248) | 11(255) |
|---|---|---|---|---|---|---|---|---|---|---|---|---|
| 0 | 0 | 0 | 0 | 0 | 0 | 0 | 0 | 0 | 0 | 0 | 0 | 255 |
| 32 | 0 | 32 | 0 | 0 | 0 | 0 | 0 | 0 | 0 | 0 | 0 | 255 |
| 64 | 0 | 0 | 64 | 0 | 0 | 0 | 0 | 0 | 0 | 0 | 0 | 255 |
| 96 | 0 | 0 | 0 | 96 | 0 | 0 | 0 | 0 | 0 | 0 | 0 | 255 |
| 128 | 0 | 0 | 0 | 0 | 128 | 0 | 0 | 0 | 0 | 0 | 0 | 255 |
| 160 | 0 | 0 | 0 | 0 | 0 | 160 | 0 | 0 | 0 | 0 | 0 | 255 |
| 192 | 0 | 0 | 0 | 0 | 0 | 0 | 192 | 0 | 0 | 0 | 0 | 255 |
| 208 | 0 | 0 | 0 | 0 | 0 | 0 | 0 | 208 | 0 | 0 | 0 | 255 |
| 224 | 0 | 0 | 0 | 0 | 0 | 0 | 0 | 0 | 224 | 0 | 0 | 255 |
| 240 | 0 | 0 | 0 | 0 | 0 | 0 | 0 | 0 | 0 | 240 | 0 | 255 |
| 248 | 0 | 0 | 0 | 0 | 0 | 0 | 0 | 0 | 0 | 0 | 248 | 255 |
| 255 | 0 | 0 | 0 | 0 | 0 | 0 | 0 | 0 | 0 | 0 | 0 | 255 |

FIG. 1 PRIOR ART

| | Before adjustment | After adjustment |
|---|---|---|
| V1 | 14.613V | 13.298V |
| V2 | 13.298V | 14.613V |
| V17 | 1.842V | 0.541V |
| V18 | 0.541V | 1.842V |

FIG. 4

DRIVING METHOD AND DRIVING APPARATUS FOR DISPLAYING APPARATUS

BACKGROUND OF THE INVENTION

1. Field of the Invention

The present invention relates to both a driving method and a driving apparatus for a display apparatus, and more particularly, to both a driving method and a driving apparatus capable of reducing a response time of a display apparatus.

2. Description of the Prior Art

An image displaying principle of a liquid crystal display (LCD) lies in externally inputting driving voltages for rearranging liquid crystal molecules of each pixel so that both a polarization state and a transmittance of lights are changed to lead in various luminances. However, liquid crystal molecules are inert to changes of external driving voltages, therefore, in comparison to a conventional cathode ray tube display, a liquid crystal display may incur image blurs while displaying animation.

For neutralizing the defect, voltage overriding may be used. For example, luminance having a gray scale G1 is originally expected to be retrieved by inputting an external driving voltage V1 for having crystal molecules to rotate with an angle θ1, however, for raising a response velocity of crystal molecules, an overdriving voltage V2 higher than the driving voltage V1 is provided as a transition driving voltage, then a stable driving voltage V1 is provided for displaying the gray scale G1. Besides, provided overdriving voltages should be changed corresponding to changes of initial states of the liquid crystal molecules. For example, an overdriving voltage V3 for having a pixel be changed from the gray scale G2 to the gray scale G1 should be different from an overdriving voltage V4 for having the same pixel changed from a gray scale G3 to the gray scale G1. Therefore, an overdriving voltage signal table may be built in the display apparatus for providing different and appropriate overdriving voltages with respect to various changes of gray scales.

Please refer to FIG. 1, which illustrates an overdriving voltage signal table. Fields in the overdriving voltage signal table having a value of 0 indicate a condition that appropriate overdriving voltages may be used for various changes of gray scales, whereas other fields having a value other than 0 indicate a condition that the provided overdriving voltage should exactly follow the value of the field. However, while referring to the table, voltage overdriving may merely be used for changes between intermediate gray scales. In other words, since the driving voltage for changing an intermediate gray scale to a highest gray scale, which has a value of 255 in the table shown in FIG. 1, has reached its maximum, a corresponding overdriving voltage cannot be provided so that the response time cannot be reduced by changing the overdriving voltage according to the overdriving voltage signal table. As a result, some technique has to be come up for performing voltage overdriving for the highest gray scale so as to reduce the response time, during which an intermediate gray scale is changed to a maximal gray scale.

SUMMARY OF THE INVENTION

Therefore, a purpose of the claimed invention is to disclose a method and apparatus thereof for driving a display apparatus so as to reduce a response time of the display apparatus.

The claimed invention discloses a driving method for a display apparatus. The driving method comprises setting a plurality of driving voltages respectively corresponding to a plurality of gray scales, which comprises a first gray scale and a second gray scale, wherein the first gray scale is corresponding to a first driving voltage, and the second gray scale is corresponding to a second driving voltage and lower than the first gray scale; and controlling the displaying apparatus to merely display up to the second gray scale.

The claimed invention discloses a driving apparatus of a display apparatus. The display apparatus comprises a reference voltage generating module and a control module. The reference voltage generating module is used for setting a plurality of driving voltages and respective corresponding to a plurality of gray scales. The plurality of gray scales comprises a first gray scale and a second gray scale smaller than the first gray scale. The first gray scale is corresponding to a first driving voltage. The second gray scale is corresponding to a second driving voltage. The control module is coupled to both the reference voltage generating module and the display apparatus for generating a control signal to the display apparatus to control the display apparatus to merely display up to the second gray scale.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 1 illustrates an overdriving voltage signal table.

FIG. 4 illustrates changing settings of Gamma reference voltages by the Gamma reference voltage generating module shown in FIG. 2.

DETAILED DESCRIPTION

Figure 2:
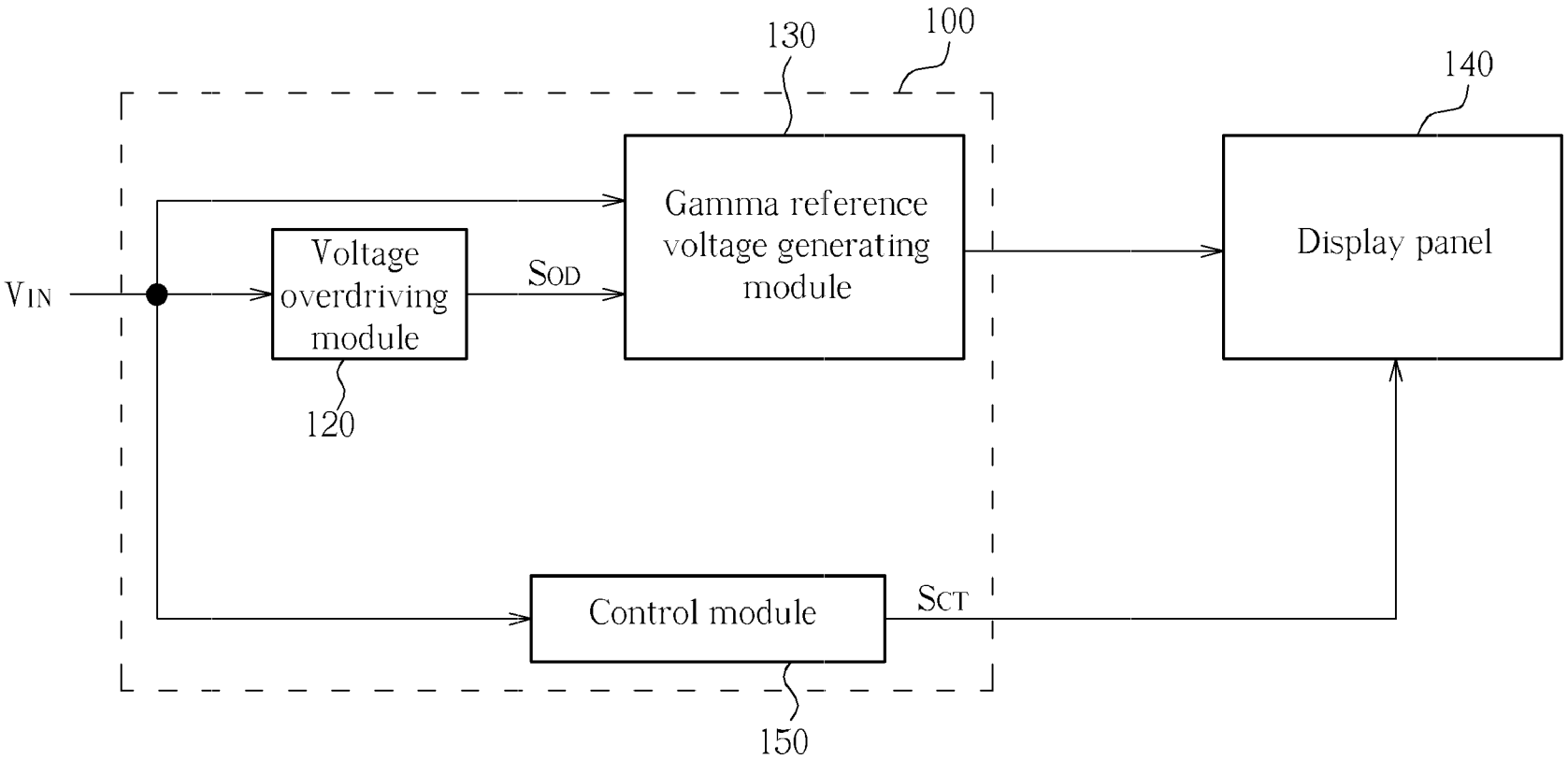
FIG. 2 illustrates a block diagram of a driving apparatus of a display apparatus according to an embodiment of the present invention.

Please refer to FIG. 2, which is a diagram of a driving apparatus of a display apparatus according to one embodiment of the present invention. In the embodiment, the display apparatus includes a display panel 140, which may be a liquid crystal display, and a driving apparatus 100. The driving apparatus 100 is used for driving the display panel 140 to display images. As shown in FIG. 1, the driving apparatus 100 includes a voltage overdriving module 120, a reference voltage generating module, which is the Gamma reference voltage generating module 130 in the present invention, and a control module 150, which may be a color tracking module. Note that merely elements related to characteristics of the present invention are illustrated in FIG. 2, however, elements included by the driving apparatus 100 are not limited to those illustrated in FIG. 2. Besides, in the embodiment, the display panel 140 is not limited to be a liquid crystal display as well, and it indicates that embodiments using any display apparatus applying the driving method of the present invention should be of the present invention.

An input gray scale signal $V_{IN}$ is an 8-bit signal indicating an integer gray scale ranged between 0 and 255 for representing 256 types of gray scale signals. The voltage overdriving module 120 is coupled to the Gamma reference voltage generating module 130 for generating a voltage overdriving signal $S_{OD}$ to the Gamma reference voltage generating module 130 so as to perform voltage overdriving by providing the display panel 140 with appropriate overdriving voltages. An overdriving voltage signal table as shown in FIG. 1 is also built in within the voltage overdriving module 120. Therefore, when a value of the input gray scale $V_{IN}$ is between 0 and 253, by referring to the built-in table, the appropriate voltage overdriving signal $S_{OD}$ is outputted to the Gamma reference voltage generating module 130 for generating a required overdriving voltage. In the embodiment, when the gray scale signal $V_{IN}$ has a value of 254 or 255, the built-in table is skipped, and instead, voltage overdriving is performed by changing settings of the Gamma reference voltage. The adjustment of the Gamma reference voltage is to be discussed latter. The Gamma reference voltage generating module 130 is coupled to the display panel 140 for generating a plurality of Gamma reference voltages and for outputting the generated Gamma reference voltages to the displaying panel 140 so as to take the generated Gamma reference voltages as succeeding reference voltages in driving liquid crystal molecules. Operations for generating the driving voltages for driving liquid crystal molecules according to the Gamma reference voltages are known for those who skilled in the art so that related details are not further described for brevity. The control module 150 is coupled to the display panel 140 for controlling a displayable range of gray scales, where the range is between 0 and 254 in the present embodiment. At last, the display panel 140 displays a corresponding gray scale according to both the Gamma reference voltage from the Gamma reference voltage generating module 130 and a control signal $S_{CT}$ from the control module 150.

Figure 3:
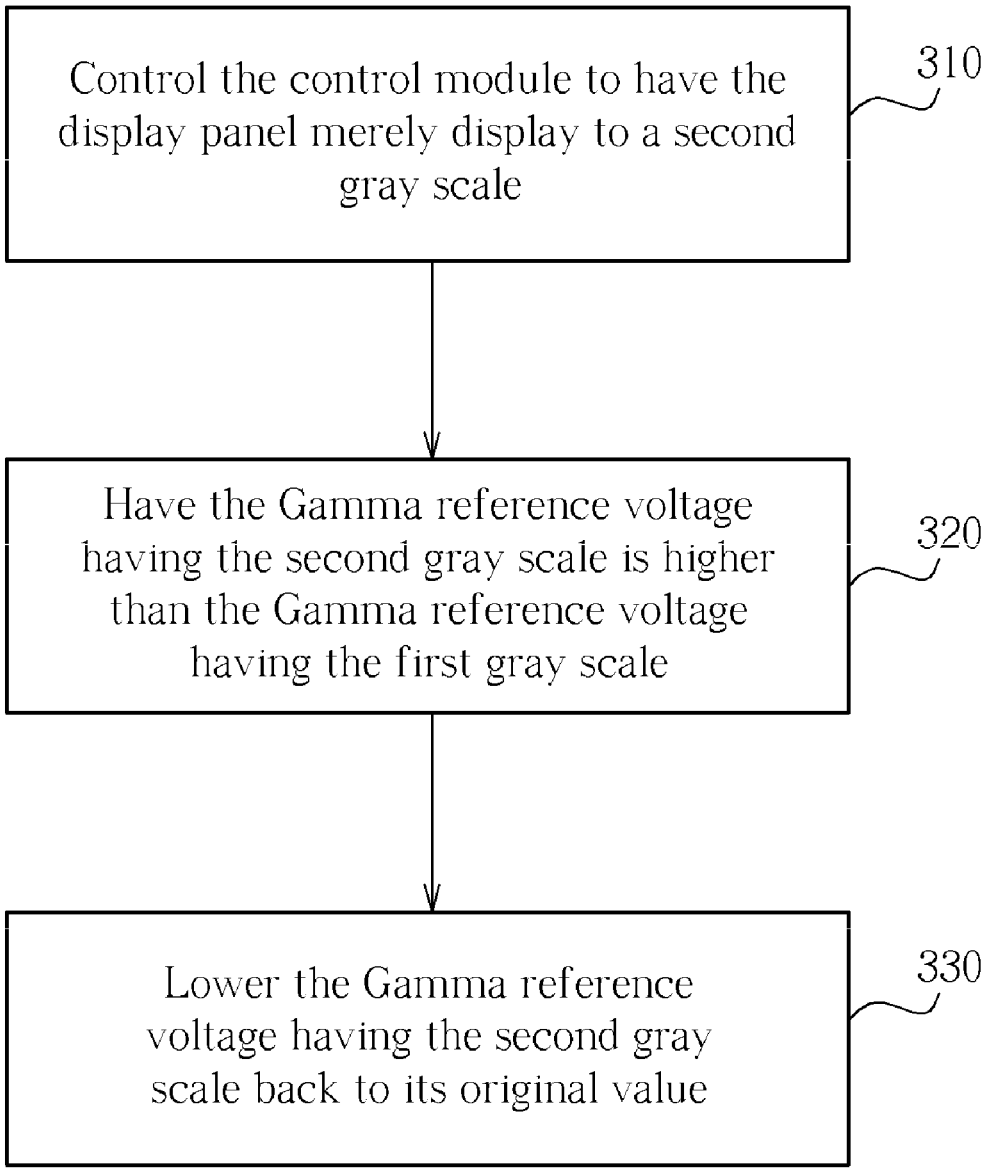
FIG. 3 is a flowchart of the method of driving a display apparatus according to an embodiment of the present invention.

As mentioned above, since the highest gray scale, which is 255 in the embodiment, in the overriding voltage signal table is a fixed and not allowed to be changed, the aim of reducing the response time by inputting the overdriving voltage in the present invention is reached by the adjustment of the Gamma reference voltage. Please refer to FIG. 3, which is a flowchart of driving the display apparatus, which may be a LCD, according to an embodiment of the present invention. Note that a flow of the flowchart in FIG. 3 is not required to be strictly followed as long as the aim of the present invention can be reached. In other words, combinations and permutations of the steps shown in FIG. 3 should not be limitations to the present invention. Also note that the flowchart in FIG. 3 merely illustrates steps related to the present invention. As shown in FIG. 3, the method of driving a display apparatus of the present invention are listed as follows:

Step 310: Control the control module 150 so as to have the display panel 140 merely display to a second gray scale;

Step 320: Lower a Gamma reference voltage having a first gray scale, which is a maximal gray scale in the present invention and is higher than the second gray scale, i.e., 255, and raise a Gamma reference voltage having the second gray scale so as to have the Gamma reference voltage having the second gray scale is higher than the Gamma reference voltage having the first gray scale, and thereby have the second gray scale acquire a transition overdriving voltage; and Step 330: After performing voltage overdriving, lower the Gamma reference voltage having the second gray scale back to its original value so as to generate stable driving voltages.

Related control mechanism is conventionally used for fixing white dots and color temperatures. An effective range of the control mechanism may also be chosen by determining input parameters. Therefore, in Step 310, the control module 150 is used for control an available displaying range of gray scales of the display panel 140. In the present embodiment, through controls of the control module 150, a maximal gray scale displayed by the display panel 140 is 254, instead of the predetermined gray scale 255. Therefore, when the input gray scale is 255, a practical displayed luminance has a gray scale of 254. In other words, with the aid of the introduced control mechanism, a displayable range of gray scales of the display panel 140 is between 0 and 254. At this time, under conditions that the input gray scale is 254 or 255, the display panel 140 displays with a same stable driving voltage corresponding to the same gray scale 254.

Besides, when the gray scale signal $V_{IN}$ indicates a gray scale of 254 or 255, in Step 320, settings related to Gamma reference voltages are changed so that the display panel 140 is able to provide voltage overdriving while the maximal gray scale 254 is displayed. Please refer to FIG. 4, which illustrates settings of the Gamma reference voltages changed by the Gamma reference voltage generating module 130 shown in FIG. 2. The Gamma reference voltage generating module 130 generates a plurality of voltages to define a plurality of Gamma reference voltages. For example, the voltages V1, V2, V17, and V18 are used for defining Gamma reference voltages VREF_254 of the gray scale 254 and VREF_255 of the gray scale 255, where the Gamma reference voltage VREF_255 is defined by both the voltages V1 and V18, and the Gamma reference voltage VREF_254 are defined by both the voltages V2 and V17. Before the adjustment, i.e., before Step 320 is executed, exemplary voltages of the voltages V1, V2, V17, and V18 are 14.613 volts, 13.298 volts, 1.842 volts, and 0.541 volts in turn. After the adjustment, the voltages V1, V2, V17, and V18 are respectively changed to 13.298 volts, 14.613 volts, 0.541 volts, and 1.842 volts in turn. Therefore, the Gamma reference voltage VREF_254 of the gray scale 254 after the adjustment is changed to be the Gamma reference voltage VREF_255 before the adjustment. Therefore, when the display panel 140 displays the maximal gray scale 254, since the Gamma reference voltage VREF_255, which is higher than the gamma reference voltage VREF_254 before the adjustment, is used for driving, the voltage overdriving is fulfilled. After a while, when Step 330 is executed, the Gamma reference generating module 130 restores the original settings of the Gamma reference voltages. That is, all the voltages V1, V2, V17, and V18 are restored to respective original voltages before the adjustment shown in FIG. 4. Therefore, while displaying the maximal gray scale 254, the display panel 140 still takes the Gamma reference voltage VREF_254 before the adjustment as the stable driving voltage.

As mentioned above, when the control module 150 controls the display panel 140 to display gray values up to the gray scale 254, and when the gray scale signal $V_{IN}$ indicates the gray scale 254, Step 320 is executed so that the display panel 140 displays the maximal gray scale 254 with voltage overdriving. However, when the gray scale signal $V_{IN}$ indicates a gray scale between 0 and 253, a corresponding transition overdriving voltage still has to be referred from the overdriving voltage signal table shown in FIG. 1.

Note that in the above embodiment, an available displaying range of the display panel 140 is between 0 and 254. However, in an other embodiment of the present invention, when the input gray scale is 0, a corresponding luminance of the input gray scale may be a luminance for the gray scale 1. In other words, a displayable range of gray scales of the display panel 140 is between 1 and 254. At this time, for both the input gray scales 0 and 1, a same stable driving voltage, which is corresponding to the gray scale 1, is used by the display panel 140 for displaying. The condition for both the gray scales 0 and 1 is similar with the condition for both the gray scales 254 and 255, and thus is not repeatedly described.

Figure 5:
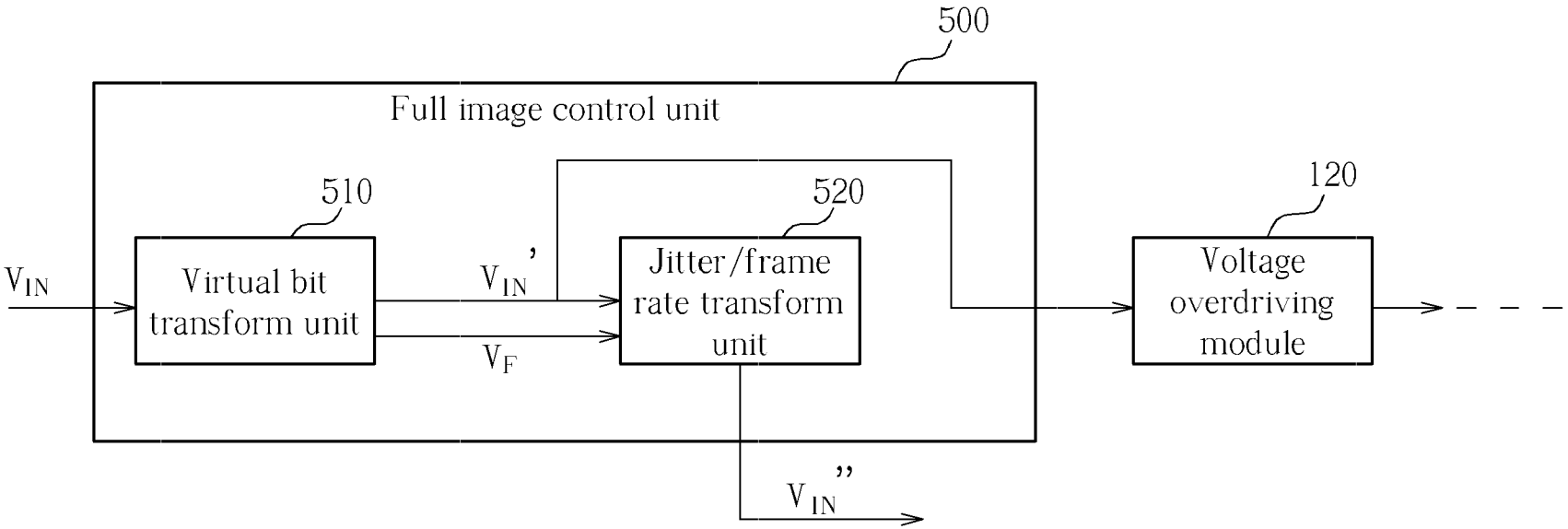
FIG. 5 is a diagram of a full color image control unit.

Besides, in the above embodiment of the present invention, no matter a display scene is stable or animated, the display panel 140 displays with 256 different gray scales for indicating 8-bit signal. However, in another embodiment of the present invention, a full color image control unit may further be added within the driving apparatus 100 shown in FIG. 2 for controlling a number of bits of gray scale signals for driving the display panel 140, where the full color image control unit is coupled to the overdriving voltage module 120 and is for receiving the gray scale signal $V_{IN}$. FIG. 5 is a diagram of a full color image control unit 500. As shown in FIG. 5, the full color image control unit 500 includes a virtual bit transform unit 510 and a jitter/frame rate transform unit 520. Under the condition that animated scenes are displayed, the virtual bit conversion unit 510 fetches last two bits of the 8-bit gray scale $V_{IN}$, and attaches a virtual bit to the fetched bits to generate a 3-bit gray scale division signal $V_F$; a 6-bit gray scale signal $V_{IN}'$ is generated by discarding both the fetched bits from the gray scale signal $V_{IN}$; the display panel 140 is driven according to the 6-bit gray scale signal $V_{IN}'$ by the overdriving voltage module. Under the condition that static scenes are displayed, the jitter/frame rate conversion unit 520 outputs 256 types of gray scales according to both the gray scale division signal $V_F$ and the 6-bit gray scale signal $V_{IN}'$ for displaying with 16.7 millions of colors. The driving method of the present invention may be briefed as the follow paragraph.

First, under the condition that animated scenes are displayed, as mentioned above, the virtual bit transform unit 510 generates both the 3-bit gray scale division signal $V_F$ and the 6-bit gray scale signal $V_{IN}'$, and the display panel 140 is driven by the overdriving voltage module 120 according to the 6-bit gray scale signal $V_{IN}'$. As described in embodiments in FIG. 2 and FIG. 3, through controls of the control module 150, the display panel 140 displays with a range between 1 and 62 instead of an original range between 0 and 63. When the 6-bit gray scale signal $V_{IN}'$ indicates a gray scale 0 or 63, the display panel 140 performs voltage overdriving according to operations related to descriptions in FIG. 2 and FIG. 3. However, when the 6-bit gray scale signal $V_{IN}'$ indicates a gray scale between 1 and 62, the transition overdriving voltage signal still has to be referred from the overdriving voltage signal table shown in FIG. 1. For example, when the gray scale signal $V_{IN}$ indicates '00000000', the gray scale signal $V_{IN}'$ is '000001'.

Under the condition that animated scenes are displayed, the jitter/frame rate conversion module 520 takes the 3-bit gray scale division signal $V_F$ to add 7 types of gray scales between two consecutive gray scales of the 6-bit gray scale signal $V_{IN}'$. For the gray scale signal $V_{IN}'$ ranged from 1 and 62, there are 489 (=62*8−8+1) types of gray scales with the aid of the 3-bit gray scale division signal $V_F$ and more than 256 types of gray scales indicated by a 8-bit gray sale signal. Therefore, 256 types of gray scales may be randomly chosen from the 489 types of gray scales to generate a gray scale signal $V_{IN}''$ so as to drive the display panel 140 and to reach the 16.7 millions of colors.

Benefits of the present invention lie in the reduced response time. By adjusting both the Gamma reference voltages of the first gray scale and the second gray scale, a Gamma reference voltage corresponding to a larger gray scale, i.e. the first gray scale, is lower than a Gamma reference voltage corresponding to a smaller gray scale, i.e., the second gray scale. The display apparatus can merely display up to the second gray scale by color tracking. Therefore, an additional gray scale may be used for performing voltage overdriving without increasing loop capitals so as to reduce the response time.

Those skilled in the art will readily observe that numerous modifications and alterations of the device and method may be made while retaining the teachings of the invention.

What is claimed is:

1. A driving method for a display apparatus comprising:

setting a plurality of driving voltages respectively corresponding to a plurality of gray scales, which comprises a first gray scale and a second gray scale, wherein the first gray scale is corresponding to a first driving voltage, and the second gray scale is corresponding to a second driving voltage and lower than the first gray scale;

receiving a gray scale signal; and controlling the displaying apparatus to merely display up to the second gray scale;

wherein the first gray scale is a largest gray scale among the plurality of gray scales, and the second gray scale is a second largest gray scale among the plurality of gray scales; and when a gray scale of the gray scale signal equals the first gray scale, the second driving voltage is utilized to drive the display apparatus to make the display apparatus display the second gray scale; and when the gray scale of the gray scale signal equals the second gray scale, the second driving voltage is utilized to drive the display apparatus to make the display apparatus display the second gray scale;

wherein when the gray scale corresponding to the gray scale signal equals the first gray scale or the second gray scale, the driving method further comprises:

driving the display apparatus according to the second driving voltage for displaying the second gray scale; and setting the second gray scale have the first driving voltage during an enabling period of a scan line, and driving the display apparatus to display they scale signal according to the first driving voltage.

2. The driving method of claim 1 wherein controlling the displaying apparatus to merely display up to the second gray scale comprises:

performing a color tracking operation to control the display apparatus to display merely up to the second gray scale.

3. The driving method of claim 1 wherein the plurality of driving voltages are Gamma reference voltages.

4. The driving method of claim 1 wherein the display apparatus is a liquid crystal display.

5. The driving method of claim 1, wherein when the gray scale of the gray scale signal equals the first gray scale or the second gray scale, the first driving voltage corresponding to the first gray scale is lower than the second driving voltage corresponding to the second gray scale, and the display apparatus merely displays up to the second gray scale; when the gray scale corresponding to the gray scale signal does not equal to either one of the first gray scale and the second gray scale, the first driving voltage corresponding to the first gray scale is higher than the second driving voltage corresponding to the second gray scale, and the first driving voltage is allowed to be used as an overdriving voltage to drive the display apparatus; and the driving method further comprising:

generating an overdriving voltage signal according to the gray scale signal; and driving the display apparatus according to a driving voltage corresponding to the gray scale of the overdriving voltage signal and among the plurality of driving voltages.

6. The driving method of claim 1 wherein the plurality of gray scales comprises a third gray scale and a fourth gray scale smaller than the third gray scale; the fourth gray scale is a smallest gray scale among the plurality of gray scales, and the third gray scale is a next-to-smallest gray scale among the plurality of gray scales; the third gray scale is corresponding to a third driving voltage, and the fourth gray scale is corresponding to a fourth driving voltage; and the method further comprising:

performing a color tracking operation to control the display apparatus to display merely up to the third gray scale.

7. The driving method of claim 6 wherein when the gray scale corresponding to the gray scale signal equals the third gray scale or the fourth gray scale, the fourth driving voltage corresponding to the fourth gray scale is larger than the third driving voltage corresponding to the third gray scale, and the display apparatus merely displays up to the third gray scale; when the gray scale corresponding to the gray scale signal does not equal to the third gray scale or the fourth gray scale, the third driving voltage is higher than the fourth driving voltage, and the fourth driving voltage is allowed to be used as an overdriving voltage to drive the display apparatus;

the driving method further comprising:

generating an overdriving voltage signal according to the gray scale signal; and driving the display apparatus according to a driving voltage corresponding to a gray scale of the overdriving voltage signal and among the plurality of driving voltages.

8. A driving apparatus for display apparatus comprising:

a reference voltage generating module for setting a plurality of driving voltages respectively corresponding to a plurality of gray scales, wherein the plurality of gray scales comprises a first gray scale and a second gray scale smaller than the first gray scale, the first gray scale is corresponding to a first driving voltage, and the second gray scale is corresponding to a second driving voltage; and a control module coupled to both the reference voltage generating module and the display apparatus, for generating a control signal to the display apparatus to control the display apparatus to merely display up to the second gray scale, and for receiving a gray scale signal to drive the display apparatus;

wherein the first gray scale is a largest gray scale among the plurality of gray scales, and the second gray scale is a second largest gray scale among the plurality of gray scales; and when a gray scale of the gray scale signal equals the first gray scale, the control module utilizes the second driving voltage to drive the display apparatus to display the second gray scale; and when the gray scale of the gray scale signal equals the second gray scale, the control module utilizes the second driving voltage to drive the display apparatus to display the second gray scale;

wherein when the gray scale of the gray scale signal equals the first gray scale or the second gray scale, the reference generating module first drives the display apparatus to display the second gray scale according to the second driving voltage, and then during an enabling period of a scan line, the reference generating module sets the second gray scale to have the first driving voltage, and drives the display apparatus according to the first driving voltage.

9. The driving apparatus of claim 8 wherein the control module is a color tracking module, and the control signal is a color tracking control signal.

10. The driving apparatus of claim 8 wherein the reference voltage generating module is a Gamma reference voltage generating module, and the plurality of driving voltages are Gamma reference voltages.

11. The driving apparatus of claim 8 wherein the display apparatus is a liquid crystal display.

12. The driving apparatus of claim 8 further comprising:

a voltage overdriving module coupled to the reference voltage generating module;

wherein when the gray scale of the gray scale signal equals the first gray scale or the second gray scale, the first driving voltage corresponding to the first gray scale is set by the reference voltage generating module to be lower than the second driving voltage corresponding to the second gray scale, and the control module controls the display apparatus to merely display up to the second gray scale; when the gray scale corresponding to the gray scale signal does not equal to either one of the first gray scale and the second gray scale, the reference voltage generating module sets the first driving voltage corresponding to the first gray scale to be higher than the second driving voltage corresponding to the second gray scale; the control module controls allowing the first driving voltage to be used as an overdriving voltage to drive the display apparatus; the voltage overdriving module generates an overdriving voltage signal to the reference voltage generating module according to the gray scale signal; and the reference voltage generating module drives the display apparatus according to a driving voltage corresponding to the gray scale of the overdriving voltage signal and among the plurality of driving voltages.

13. The display apparatus of claim 8 wherein the plurality of gray scales comprises a third gray scale and a fourth gray scale smaller than the third gray scale; the fourth gray scale is a smallest gray scale among the plurality of gray scales, and the third gray scale is a next-to-smallest gray scale among the plurality of gray scales; the third gray scale is corresponding to a third driving voltage, and the fourth gray scale is corresponding to a fourth driving voltage; and the control module generates the control signal to the display apparatus so as to control the display apparatus to display up to the third gray scale.

14. The driving apparatus of claim 13 further comprising:

a voltage overdriving module coupled to the reference voltage generating module;

wherein when the gray scale corresponding to the gray scale signal equals the third gray scale or the fourth gray scale, the reference voltage generating module sets the fourth driving voltage corresponding to the fourth gray scale to be larger than the third driving voltage corresponding to the third gray scale, and the control module controls the display apparatus to merely display up to the third gray scale; when the gray scale corresponding to the gray scale signal does not equal to the third gray scale or the fourth gray scale, the reference voltage generating module sets the third driving voltage to be higher than the fourth driving voltage; the control module controls allowing the fourth driving voltage to be used as an overdriving voltage to drive the display apparatus; the voltage overdriving module generates an overdriving voltage signal to the reference voltage generating module according to the gray scale signal; and the reference voltage generating module drives the display apparatus according to a driving voltage corresponding to a gray scale of the overdriving voltage signal and among the plurality of driving voltages.

* * * * *